United States Patent [19]

Böhlen

[11] Patent Number: 4,715,511

[45] Date of Patent: Dec. 29, 1987

[54] PACK COMPRISING AN OUTER RIGID ENVELOPE AND AN INNER FLEXIBLE ENVELOPE

[75] Inventor: Dietrich Böhlen, Puidoux, Switzerland

[73] Assignee: Nestec S.A., Vevey, Switzerland

[21] Appl. No.: 909,143

[22] Filed: Sep. 18, 1986

[30] Foreign Application Priority Data

Oct. 3, 1985 [CH] Switzerland ..... 4279/85

[51] Int. Cl.[4] ..... B65D 5/54

[52] U.S. Cl. ..... 220/403; 220/404; 229/3.1

[58] Field of Search ..... 220/403, 402, 404; 229/3.1

[56] References Cited

U.S. PATENT DOCUMENTS 2,352,503 6/1944 Walton ..... 220/404
3,065,894 11/1962 Lipschultz et al. ..... 220/403
3,112,047 11/1963 Weinreich et al. ..... 220/403
3,233,817 2/1966 Casady ..... 220/403
3,955,743 5/1976 Tanneberger ..... 220/403

FOREIGN PATENT DOCUMENTS 3016466 11/1980 Fed. Rep. of Germany ..... 220/403

*Primary Examiner*—Willis Little
*Attorney, Agent, or Firm*—Vogt & O'Donnell

[57] ABSTRACT

A pack is constructed of a rigid outer envelope with flaps, a flexible inner envelope and means for immobilizing the flexible inner envelope in relation to the outer envelope. The immobilization means extends over one face of the outer envelope and to at least one flap, is designed to form an opening opposite a cut-out or a corresponding cutting line of said face and an opening to the flexible inner envelope and is fixed at least at the opening to the flexible inner envelope to form a tamper-proof membrane.

14 Claims, 2 Drawing Figures

PACK COMPRISING AN OUTER RIGID ENVELOPE AND AN INNER FLEXIBLE ENVELOPE

This invention relates to a pack comprising a rigid envelope with flaps, a flexible inner envelope and means for immobilizing the flexible inner envelope in relation to the outer envelope.

FR-PS No. 2 395 913 relates to a flexible pack contained in a rigid envelope which facilitates handling and promotes conservation of the liquid contents and which comprises means for immobilizing the neck of the flexible container in relation to the rigid outer envelope in which it is contained. The disadvantages of this type of pack are inherent in the presence of the neck on the flexible container. This is because the presence of this neck eliminates the oxygen and water vapour barrier effect of the flexible container and, on the other hand, destroys any tamper-proof guarantee of the pack as a whole. In addition, this closure system definitely does not provide for perfect sealing, a particularly critical phenomenon when the packs are in transit.

The object of the present invention is to provide a pack which is not attended by any of the above-mentioned disadvantages. The invention relates to a pack in which an immobilization means extends over one face of an outer envelope and projects beyond each side of said face by a distance substantially equal to or shorter than the length of a flap associated with said face. The immobilization means is designed to form an opening opposite a cut-out or a corresponding cutting line of said face and is fixed substantially along said opening to the flexible inner envelope forming a tamper-proof membrane. The inner envelope is designed for lateral filling with solid, liquid or pasty products.

The immobilization means is formed either by heat or by pressure and is fixed, preferably by welding, to the inner envelope.

The products capable of being accommodated in the pack according to the invention are solids, such as products in the form of particles, granules or powders, such as coffee grains, soluble coffee and cocoa powder; liquids, such as fruit juices, wine; and pasty products, such as salad dressing or mustard and ice cream. It is obvious that this list is by no means complete.

The pack according to the invention is designed for lateral filling which has a certain number of advantages over conventional systems: the filling rate is increased, there is no need for air to be removed before filling and filling takes place without free head space.

The advantage of the immobilization means is that it enables the flexible inner envelope to be held firmly in the outer envelope, above all, in transit, during storage and when the pack is being emptied.

The rigid outer envelope is preferably a cubic or parallelepipedic cardboard box.

The immobilization means is in the form of a rectangular sheet which is rigid, but flexible enough for immobilization by flexion between the flaps of the rigid outer envelope. The immobilization means is preferably thermoformed and comprises a base for a closure means, for example, a cover in the packing of dehydrated products or a dispensing means, for example, a pump, in the packing of mustard or other pasty or liquid products. This base is opposite a cut-out or a cutting line, defining an opening, of the corresponding face of the outer rigid envelope. Any type of material which is thermoformable or formable by pressure and heat, namely plastics or plastic-coated cardboard, and which is weldable to the flexible envelope may be used for the immobilization means. The immobilization means preferably consists of polystyrene, polyethylene, plastic-coated cardboard, aluminium paper or a composite of these materials. It is also possible to use recycled materials, such as mixtures of plastic and aluminium paper. The thickness of the immobilization means is from 500 to 1000 microns, depending on whether the pack is designed for liquid or dehydrated products. In addition, the thickness of the immobilization means depends upon the desired holding effect on the flexible inner envelope and the closure or dispensing means provided on the pack in question.

So far as the flexible inner envelope is concerned, it is possible to use any plastics or combinations of plastics both with one another and with paper and aluminium. They have to satisfy the following requirements: afford the desired protection for a given product, guarantee weldability to the immobilization means and have a certain flexibility for emptying without allowing in any air. This envelope is preferably made of polystyrene, polyethylene, polypropylene, EVAL (ethylene/vinyl alcohol copolymer), polyester, plastic-coated paper, aluminium paper or a composite of these materials.

The invention is described in more detail in the following with reference to the accompanying drawings.

DETAILED DESCRIPTION OF THE INVENTION

Figure 1:
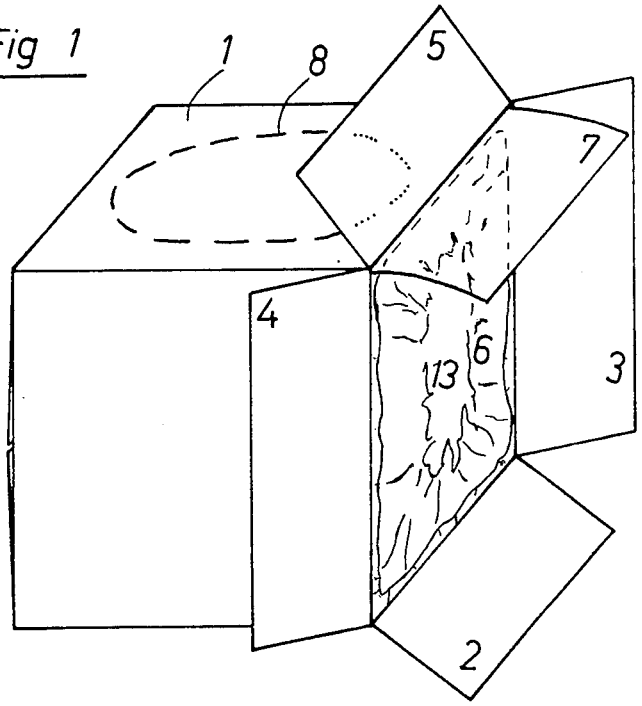
FIG. 1 is a perspective view of the pack according to the invention open laterally.
Figure 2:
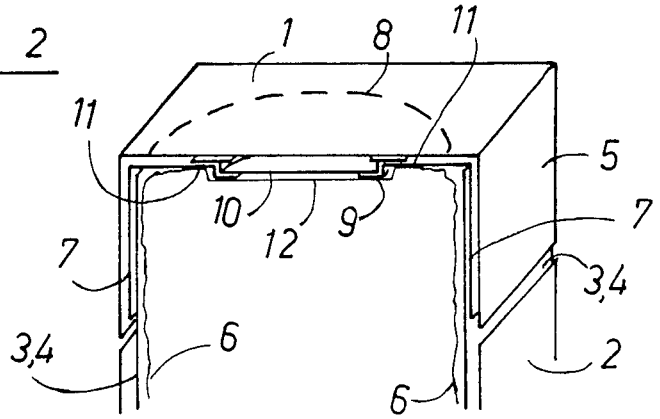
FIG. 2 is a section through the closed pack.

The pack comprises a rigid outer envelope (1) with flaps (2,3,4,5), a flexible inner envelope (6) and an immobilization means (7). The outer envelope comprises a cut-out (8) opposite the base (9) designed to receive a cover (10) (FIG. 2). This base (9) emanates from the thermoforming of the immobilization means (7) into which an opening is cut out at the level of said base. The flexible inner envelope (6) is then welded to the immobilization means (7) at (11), the envelope (6) forming a closure membrane (12) at the level of the base (9). The pack is ready for filling. The opening (13) in the flexible envelope (6) is offered to a filling machine for vertical filling.

The pack may be filled either with the envelope (6) already engaged or not engaged in the rigid outer envelope.

On completion of filling, the inner envelope (6) is sealed, the flaps (3) and (4) are closed, the immobilization means (7) is folded from above and, finally, the flaps (5) and (2) are closed.

The invention thus relates to the formation of a perfectly sealed, tamper-proof pack having a good oxygen barrier effect. By virtue of the immobilization means (7), this pack shows high stability in transit and in storage: the risks of crushing are minimized. When it is desired to use the product accommodated in this pack, the cut-out (8) is taken out, the cover (10) is removed and the membrane (12) is cut close to the base (9) to expose a product which has kept all its qualities intact. After use, the cover (10) is replaced.

This type of pack may be used in any applications involving the packaging of products.

I claim:

1. A pack comprising (a) a rigid outer envelope having at least one face and at least one flap associated with the face;

(b) a flexible inner envelope located within the outer envelope; and (c) immobilization means between the inner and outer envelope and affixed to the inner envelope, the immobilization means abutting a face of the outer envelope and extending to each flap associated with the face, and having an opening positioned opposite and corresponding with an opening defined on the face.

2. A pack according to claim 1 wherein the defined face opening is a cutting line.

3. A pack according to claim 1 wherein the defined face opening is a cut-out.

4. A pack according to claim 1 wherein the immobilization means is affixed to the inner envelope at least at the opening of the immobilization means.

5. A pack according to claim 1 wherein the immobilization means extends substantially to the edge of each flap.

6. A pack according to claim 1 wherein the immobilization means is made of a material which is rigid and allows flexion.

7. A pack according to claim 1 wherein there are two flaps associated with the at least one face.

8. A pack according to claim 1 or 6 wherein the immobilization means is made of material selected from the group consisting of polystyrene, polyethylene, plastic-coated cardboard, aluminum paper and composites of these materials.

9. A pack according to claim 1 or 6 wherein the immobilization means has a thickness of from 500 to 1000 microns.

10. A pack according to claim 1 or 6 wherein the immobilization means is formed from a rectangular sheet of material.

11. A pack according to claim 1 wherein the immobilization means is configured about its opening to form a base for a closure means.

12. A pack according to claim 1 wherein the immobilization means is configured about its opening to form a base for a dispensing means.

13. A pack according to claim 12 wherein the dispensing means is a pump.

14. A pack according to claim 1 wherein the flexible inner envelope is made of a material selected from the group consisting of polystyrene, polyethylene, polypropylene, EVAL, polyester, plastic-coated paper, aluminum paper and composites of these materials.

* * * * *